United States Patent [19]

Adamson

[11] 3,931,721

[45] Jan. 13, 1976

[54] WARP KNITTED ELASTIC FABRIC

[75] Inventor: Thomas E. Adamson, Shillington, Pa.

[73] Assignee: VF Corporation, Reading, Pa.

[22] Filed: July 22, 1974

[21] Appl. No.: 490,342

[52] U.S. Cl. ..... 66/195
[51] Int. Cl.[2] ..... D04B 21/00
[58] Field of Search ..... 66/190–195

[56] References Cited

UNITED STATES PATENTS

| | | | |
|---|---|---|---|
| 2,667,775 | 2/1954 | Aibel | 66/195 |
| 2,996,906 | 8/1971 | Ichibe | 66/192 |
| 3,254,510 | 6/1966 | Lesley | 66/195 |
| 3,442,099 | 5/1969 | Auville et al. | 66/86 |
| 3,552,154 | 1/1971 | Lesley | 66/192 |
| 3,552,155 | 1/1971 | Hartung | 66/192 |

FOREIGN PATENTS OR APPLICATIONS

| | | | |
|---|---|---|---|
| 719,475 | 3/1942 | Germany | 66/195 |

*Primary Examiner*—Ronald Feldbaum
*Attorney, Agent, or Firm*—Pennie & Edmonds

[57] ABSTRACT

This invention relates to a warp knitted elastic fabric composed of alternating non-elastic courses formed from non-elastic yarns and intervening elastic courses formed primarily with elastic thread having a knitted ground construction composed of a plurality of non-elastic threads arranged in one or two systems of warp threads formed into a plurality of wales and courses of single thread stitches. The threads of said system or systems form stitches in adjacent wales in a course and in alternate courses to form the alternating non-elastic course. A plurality of elastic threads arranged in one system of warp threads form a plurality of wales and alternate elastic courses of double elastic thread stitches. Each elastic thread forming a part of two stitches in adjacent wales in a course knitting in the intervening courses when at least half of the non-elastic threads are not knitting. The elastic courses in particular and the base fabric construction are dependent on the elastic threads being formed into knitted stitches to hold the knitted structure together, to prevent the knit structure from raveling.

The warp knitted elastic fabrics of this invention are opaque, have a soft hand, a smooth uniform surface free of streaks and a long comfort-type stretch in one direction and control-type stretch in the other direction at right angles to the said first direction. These objectives are achieved with more economical usage of elastic yarn than is possible in conventional fabrics with knitted in elastic yarn.

5 Claims, 9 Drawing Figures

Guide Bar Motions

WARP KNITTED ELASTIC FABRIC

FIELD OF THE INVENTION

Warp knit elastic fabrics are used in support-type undergarments and form fitting outerwear garments because they can be made with a range of different stretch properties at right angles to each other, their natural configuration is flat, not tubular, therefore they are easier to handle during garment manufacturing, and they are more run-resistant than other types of knitted fabrics. They can be produced faster and, therefore, are more economical than competitive woven fabrics. An object of the present invention is to provide a warp knitted elastic fabric with improved properties for figure-control and support undergarments and form-fitting outer garments, such as swimsuits. Another object of the invention is to provide a method of making elastic fabric where the fabric has a soft hand, has lightweight opacity, a smooth uniform surface free from streaks and possesses the characteristics of a long comfort-type stretch in the direction corresponding to the length of the garment embodying the same and power control-type stretch in the direction corresponding to the width of the garment.

DESCRIPTION OF THE PRIOR ART

Various elastic warp knit fabrics are known wherein non-elastic yarn is formed into a fabric or a mesh to bind and hold laid-in elastic threads within the structure in a stretched state to impart elastic properties to the fabric structure. Other elastic warp knit fabrics are known wherein the structure is formed from stitches which have non-elastic and elastic thread components. Each individual elastic thread is a component of only one stitch in a course. Fabrics with laid-in elastic yarn suffer from a high incidence of streaks if the non-elastic yarn is knit with tension on the non-elastic yarn low enough to produce a soft hand in the fabric. Fabrics with laid-in elastic yarn can be engineered to have good stretch and modulus properties in the length of the fabric but generally they have poor stretch properties in the width of the fabrics. Fabrics with single strands of elastic yarn formed into stitches with the non-elastic yarn generally have a high incidence of streaks because of the non-consistent response of the elastic yarn in the stitches. They are more costly because they require larger quantities of expensive elastic yarn for a given fabric weight. They generally have long stretch properties but have too high a modulus for support-type garments.

Warp knit elastic fabrics are known wherein a knitted ground construction composed of a plurality of pairs of non-elastic warp threads are formed into a plurality of wales and courses of single thread stitches one thread of each of the pairs forming stitches in adjacent wales and alternate courses, and wherein the other thread of each of the pairs forms stitches in non-adjacent wales and alternate courses. A plurality of elastic threads extending between the wales generally parallel thereto, are inlaid in the ground construction with a non-elastic warp thread of the ground construction wrapped about each of the elastic threads to maintain the elastic threads in the ground construction.

There are also known other eleastic warp knit fabrics comprised of a plurality of courses of elastic and non-elastic threads in which each of the elastic threads is knitted into every stitch across the width of the fabric in consecutive courses.

There are also known other elastic warp knit fabrics wherein a ground construction composed of a single non-elastic yarn system is used to bind and conceal laid-in elastic yarns from a single yarn system in such a way as to minimize the danger of the non-elastic yarn in the knitted ground structure from raveling.

Prior patents disclosing warp knit elastic fabrics include U.S. Pat. Nos. 3,069,885 (Cooper); 3,429,147 (Perrier); 3,552,154 (Lesley); 3,552,155 (Hartung); and 3,733,859 (Wittman).

SUMMARY OF THE INVENTION

A warp knit elastic fabric in accordance with the invention may be made on a conventional warp knitting machine which is capable of withstanding the stress imposed of knitting elastic fabric under tensions such as in Raschel "power net" knitting.

One version of the fabric is made from one warp of elastic thread forming all of the stitches in alternate courses in the fabric while one warp of non-elastic thread forms all of the intervening courses in the fabric.

In two other versions of the fabric one warp of elastic thread forms a component of all of the stitches in a knitted course while the two warps of non-elastic thread each form half of the stitches in a single course. Thus, the warp knit fabric so knit is composed of a lattice of knitted non-elastic threads whose stitches are held together and which holds together the stitches of a web of knitted elastic threads.

In making one of these two versions of the fabric from two warps of non-elastic thread knitting simultaneously in alternate courses, a third warp of elastic thread knits in the intervening courses. The elastic warp forms all of the stitches in a course and it forms double loops so that each elastic thread is a component of two stitches in adjacent wales in the course.

Each of the non-elastic warps forms only half of the stitches in the non-elastic courses so that one warp of non-elastic thread forms the odd-numbered stitches in the non-elastic courses while the other system of non-elastic thread forms the even-numbered stitches in the same courses while the elastic thread is mislapping (floating). Threads from the non-elastic warps float on the alternate courses while the elastic yarn is knitting. When the non-elastic warps are floating they move laterally opposite to each other the distance of the two threads so that each system continuously forms stitches in either odd-numbered or even-numbered wales in the non-elastic courses throughout the fabric.

To arrive at the new position, the threads of one non-elastic warp connecting the consecutive stitches cross over threads of the other non-elastic warp. On the next course when the elastic thread floats again and the non-elastic threads are knitting the two systems have moved the distance of two threads opposite to the previous lateral move and opposite to each other. On the fifth consecutive course the sequence repeats.

In making another version of the fabric from two warps of non-elastic thread knitting simultaneously in alternate courses and opposite to each other in the intervening courses each knitting alternately with a third warp of elastic thread in the intervening courses while the other non-elastic warp floats. The elastic thread forms the primary component of all of the stitches in a course when it knits and it forms double loops so that each elastic thread is a component of two stitches in adjacent wales in the course.

Each of the non-elastic warps forms only half of the stitches in the non-elastic courses so that one warp of non-elastic thread forms the odd-numbered stitches and the other forms even-numbered stitches in the non-elastic courses. Threads from one of the non-elastic warps floats on the first intervening elastic course and as it floats it moves laterally the distance of two threads while the elastic warp threads and the other non-elastic warp threads knit together. The non-elastic warp which knits moves laterally the distance of one thread in two consecutive courses in a direction opposite to the other non-elastic warp. In the next course both the non-elastic warps knit while the elastic warp floats. In the second invervening elastic course the elastic yarn again knits forming double stitches. The non-elastic warp that knits with the elastic threads in the first intervening elastic course floats in this course. As it floats, it moves laterally the distance of two threads in opposite lateral direction as moved previously. The non-elastic warp which floated before, knits with the elastic thread in this course and moves laterally one thread between two consecutive courses opposite to the direction of the other non-elastic warp. On the fifth consecutive course the sequence repeats.

In making a version of the fabric from one warp of non-elastic thread knitting in alternate courses, a second warp of elastic thread knits in opposite alternate courses. The elastic warp forms all of the stitches in the course and it forms double-loops so that each elastic thread is a component of two stitches in adjacent wales in the course. The non-elastic warp forms adjacent single thread stitches in alternating courses. Between courses when the non-elastic warp knits, it moves laterally the distance of one thread to the left and one to the right consecutively so that the non-elastic thread forms stitches in adjacent wales on alternate courses. On the fifth consecutive course the sequence repeats.

The elastic warp knitted fabric made with the elastic warp knitting on alternate courses in the fabric and forming double stitches when it does knit effects economy in the use of elastic yarn over conventional knitted elastic fabrics wherein the elastic thread forms single stitches in every course.

The knitted fabrics of the invention have a minimum amount of yarn committed to the loops of the knitted structure to produce an unstructured system which binds the elastic yarn in the fabric and permits the elastic yarn to be knit with sufficient tension to produce a fabric with a high degree of human figure controlling capability in garments made thereof. The retraction forces in the elastic thread reacting in a fabric with a minimum amount of knitted structure produces a high degree of contraction in the fabric without the undesirable effects of fabric compaction such as poor drape, a stiff hand and excess weight.

In the knitted fabrics of the invention, the non-elastic yarn in the unstructured portions of the fabric is more evenly distributed in yarn reserves which allows the elastic yarn to stretch with a minimum restriction from the non-elastic threads and maintain good fabric opacity throughout the normal stretch range of the fabrics.

In addition, in the knitted fabrics of the invention the stitches are sufficiently distorted to create a smooth uniform surface, and to mask inconsistencies in elastic yarns which are known to cause streaks in elastic fabrics.

DESCRIPTION OF THE PREFERRED EMBODIMENT

Figure 1:
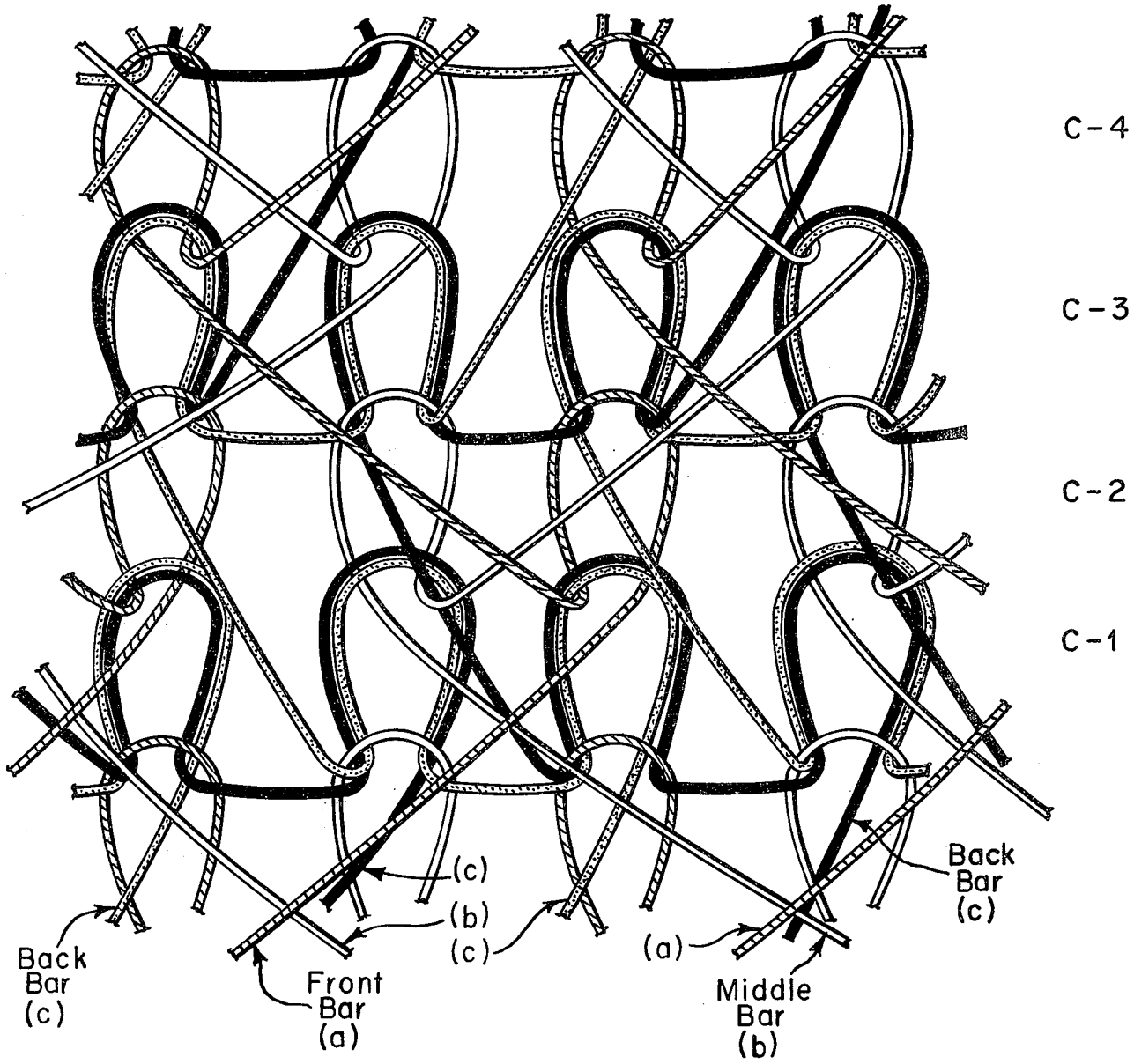
FIG. 1 illustrates the structure of the warp knit elastic fabric of the invention when it is formed with two warps of non-elastic thread which knit on the same alternate courses when the elastic threads are not knitting, as this fabric would appear on the knitting machine.

Referring to FIG. 1 which illustrates the preferred embodiment of my invention, there is shown a warp knitted elastic fabric having a knitted ground construction composed of a lattice *a*, *b* of knitted non-elastic threads. For example, 40-13-865A Brt. Nylon, which lattice is held together and holds together a web of *c* of knitted elastic threads, for example 140-1-127 Lycra either bar or Lycra covered with non-elastic thread.

This fabric is knit from two systems of non-elastic thread comprising one solid warp with individual ends threaded alternately in two guide bars in a conventional knitting machine and one system of elastic threads from one warp threaded solid in a single guide bar. The elastic thread knits in alternate courses C-1 and C-3 and forms double stitches which are part of two adjacent wales. The non-elastic thread knits intervening courses C-2 and C-4.

The non-elastic threads knit single stitches in the intervening courses, each stitch being formed from a single non-elastic thread. Between the intervening non-elastic courses the non-elastic threads float. As they float the non-elastic threads in each guide bar move laterally in opposition to each other, the distance of two wales reversing their lateral direction between consecutive intervening courses to that non-elastic threads knitting in adjacent wales in the first intervening course are separated by the wales when they knit in the next intervening course. In the following consecutive intervening course, they again knit in neighboring wales. Between the alternate elastic courses while the elastic threads are floating the guide bar moves one wale to the left and then one wale to the right between the next two alternate courses so that each elastic thread knits in one wale in every alternate course plus one wale to the left in the odd alternate courses and one wale to the right in the even alternate courses.

Figure 3:
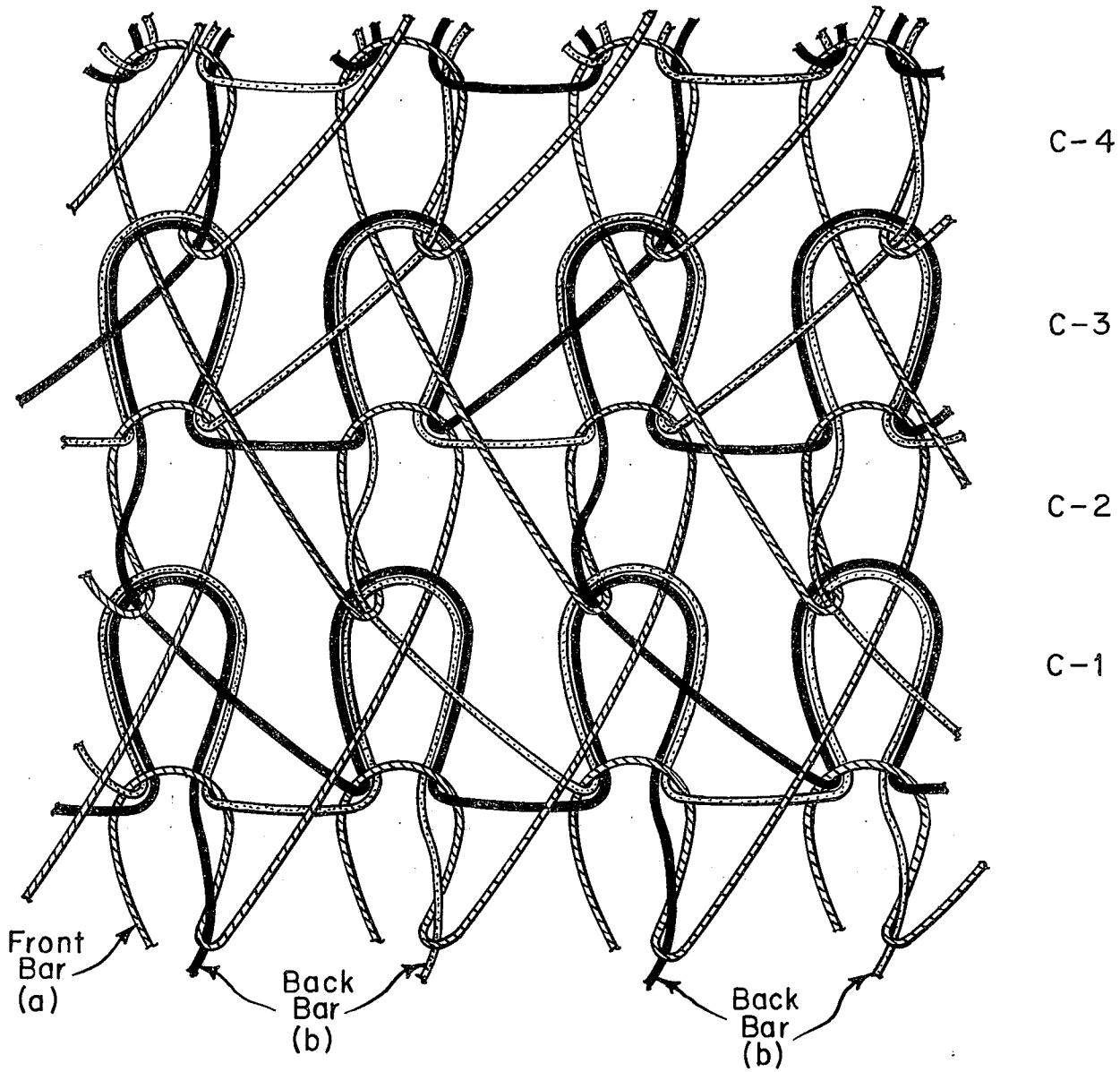
FIG. 3 illustrates the structure of the warp knit elastic fabric of the invention when it is formed with one warp of non-elastic thread which knits on alternate courses when the elastic threads are not knitting.
Figure 4A:
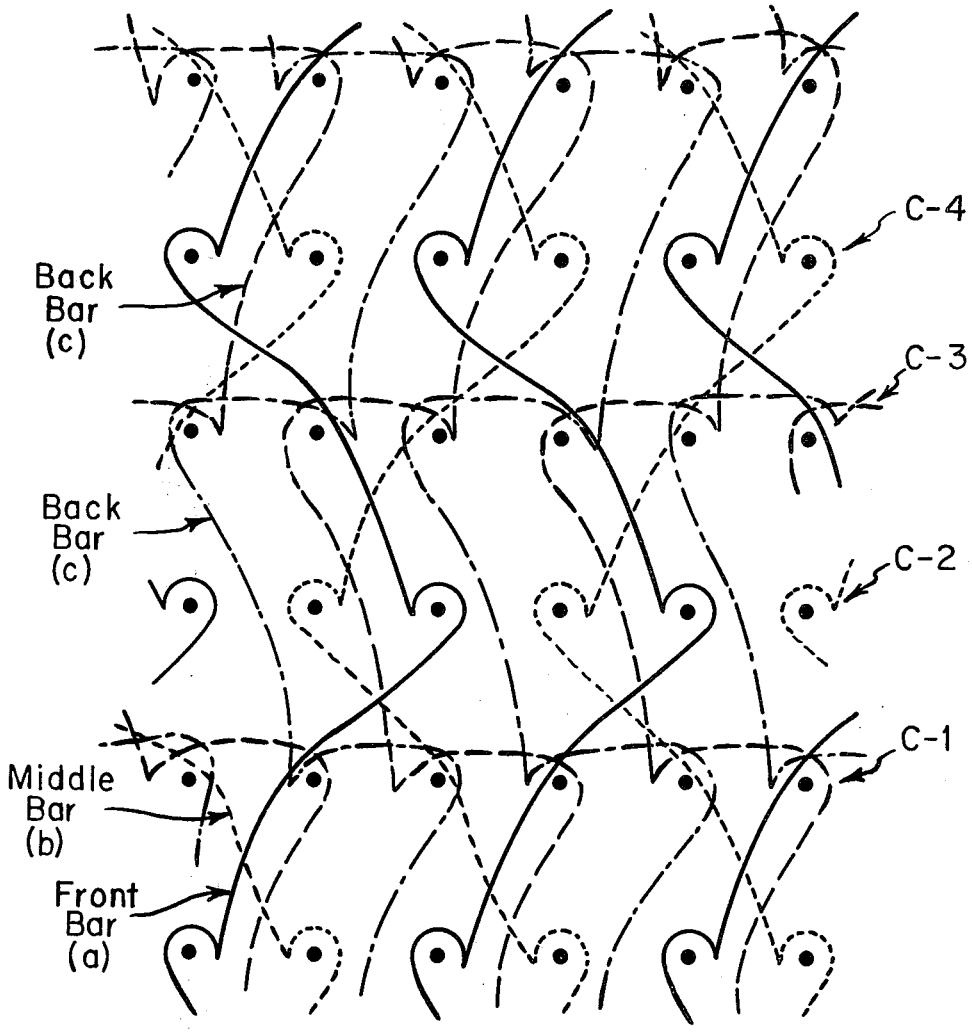
FIG. 4A illustrates the knit construction details for the fabric in FIG. 1.
Figure 4B:
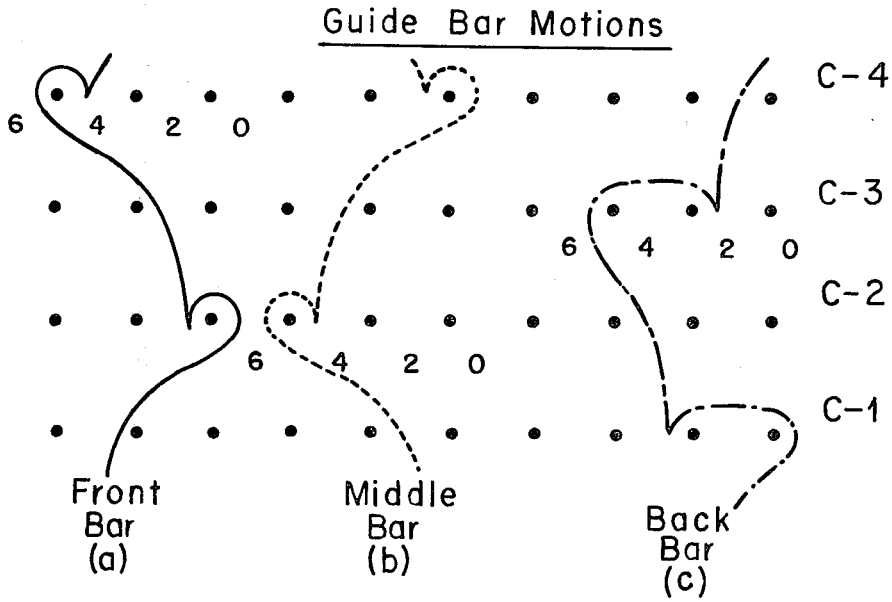
FIG. 4B is a stitch diagram of the fabric of FIG. 1.
Figure 5A:
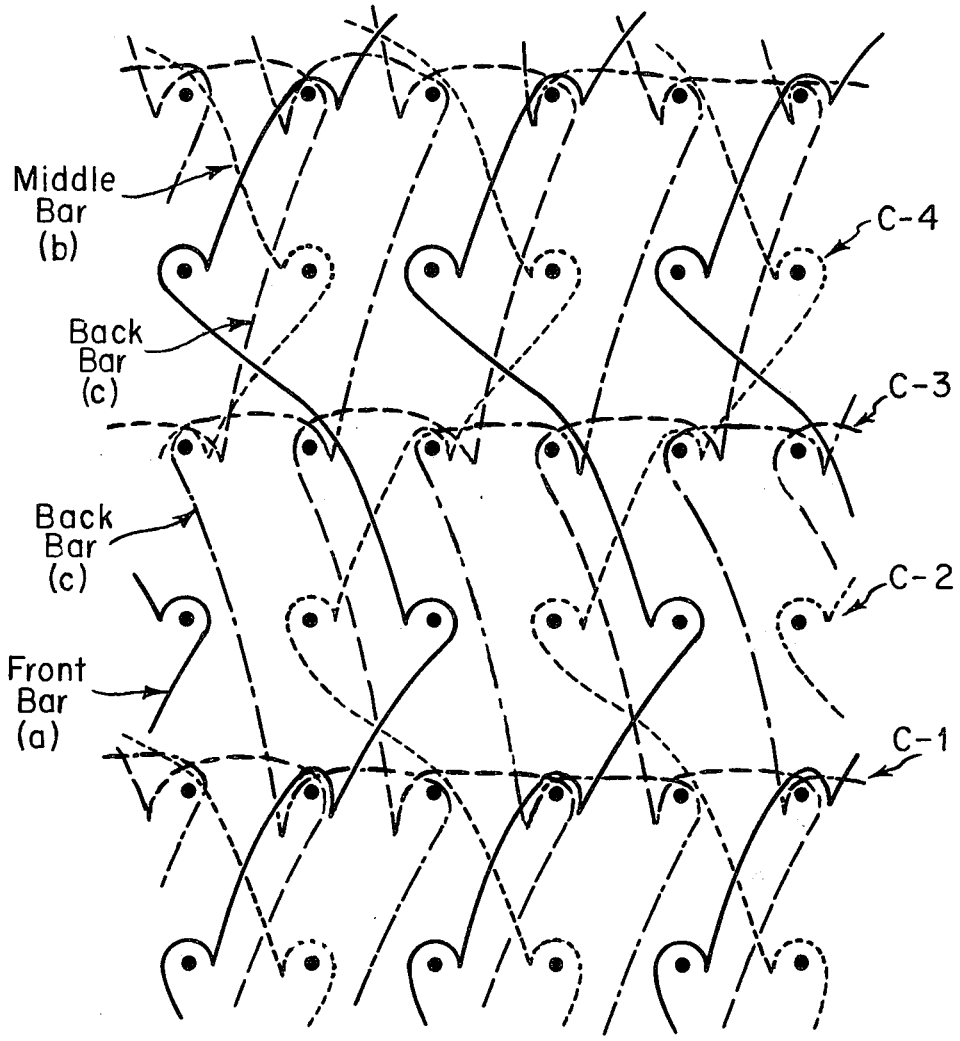
FIG. 5A illustrates the knit construction details for the fabric in FIG. 2.
Figure 5B:
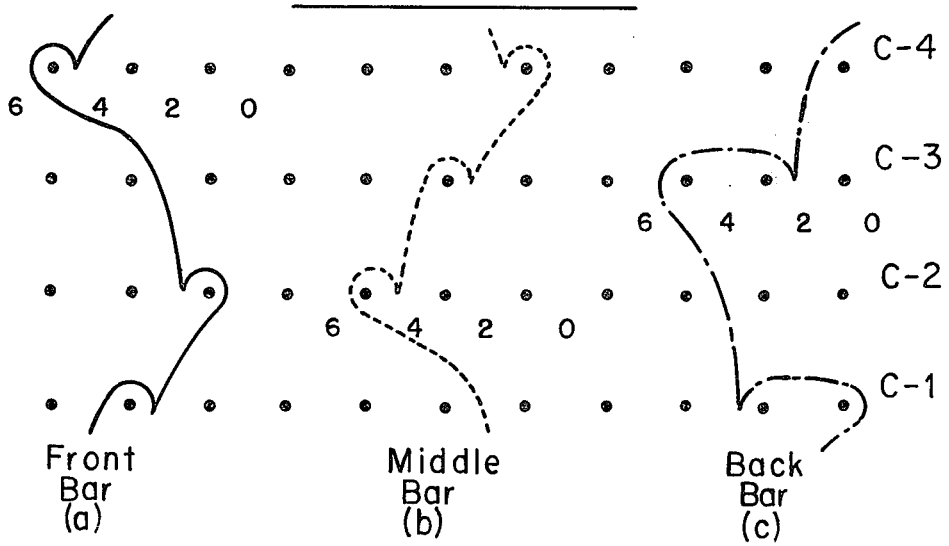
FIG. 5B is a stitch diagram of the fabric of FIG. 2.
Figure 6A:
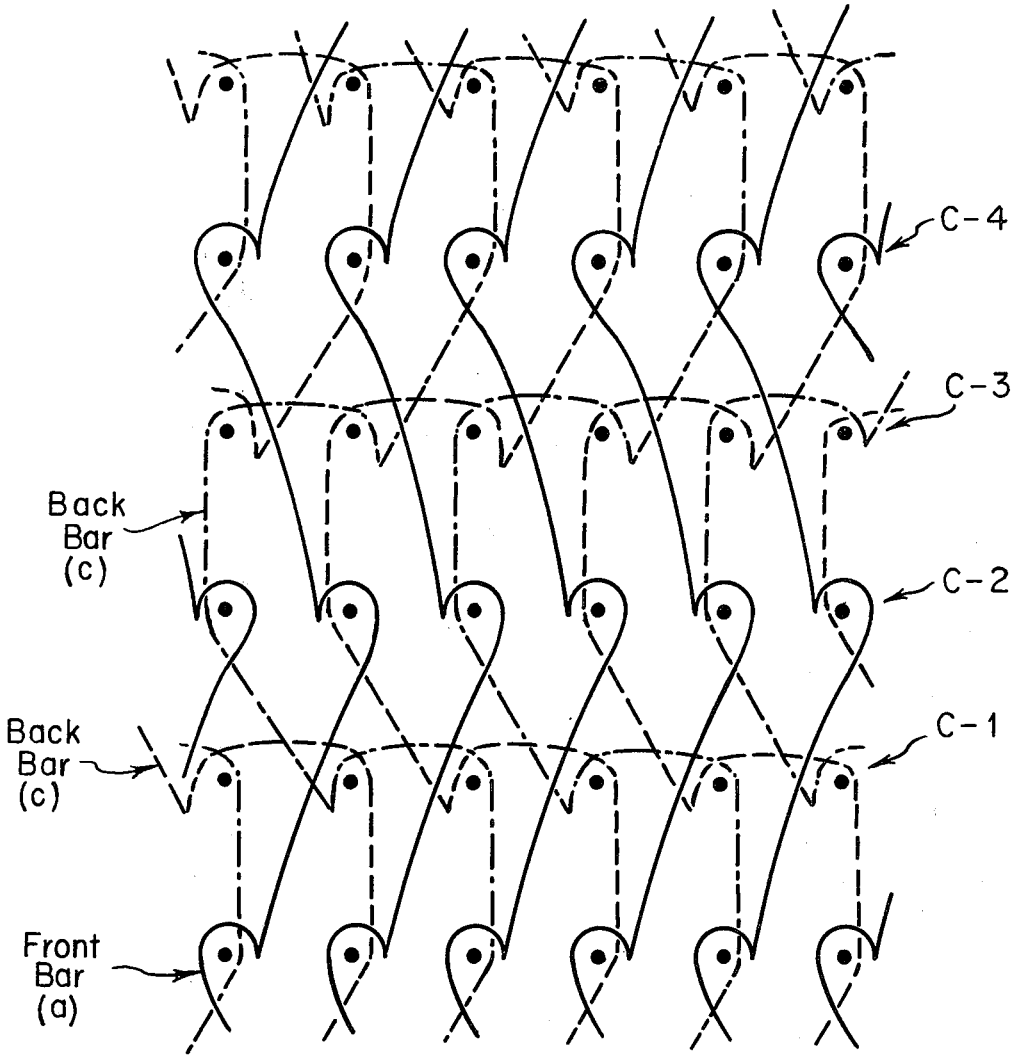
FIG. 6A illustrates the knit construction details for the fabric in FIG. 3.
Figure 6B:
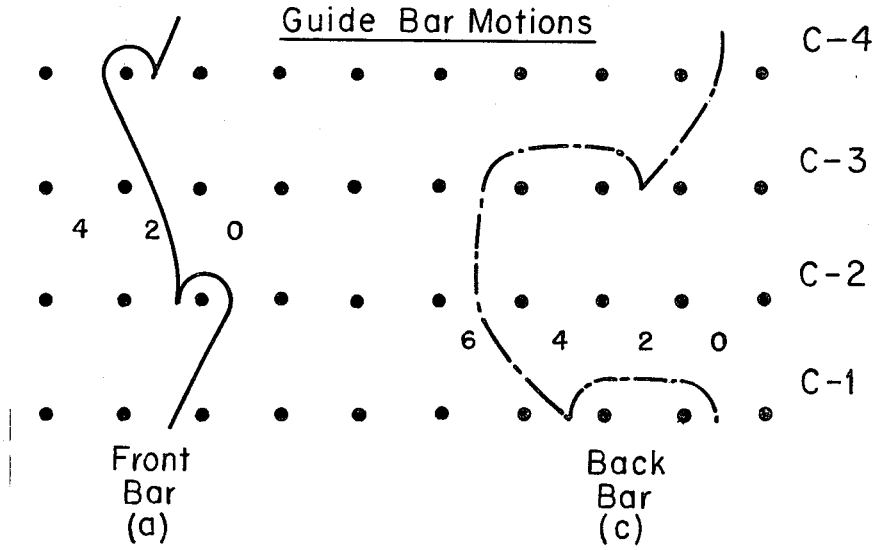
FIG. 6B is a stitch diagram of the fabric of FIG. 3.

Referring to FIG. 3 which illustrates another proposed embodiment of my invention, there is shown a warp knitted elastic fabric having a knitted ground construction composed of a lattice *a* of knitted non-elastic threads, for example, 30-18-472 Qiana Nylon, which lattice is held together and holds together a web of *b* of knitted elastic threads, for example, 280-1-127 Lycra.

In making the fabric, FIG. 3, from a base system of non-elastic thread knitting alternate courses C-2 and C-4, a second base system of elastic threads knits in intervening courses C-1 and C-3. The elastic yarn system forms all of the stitches in a course and when it knits each elastic thread forms double loops from the one warp of elastic thread so that each elastic thread is a component of two stitches in adjacent wales in the course.

Figure 2:
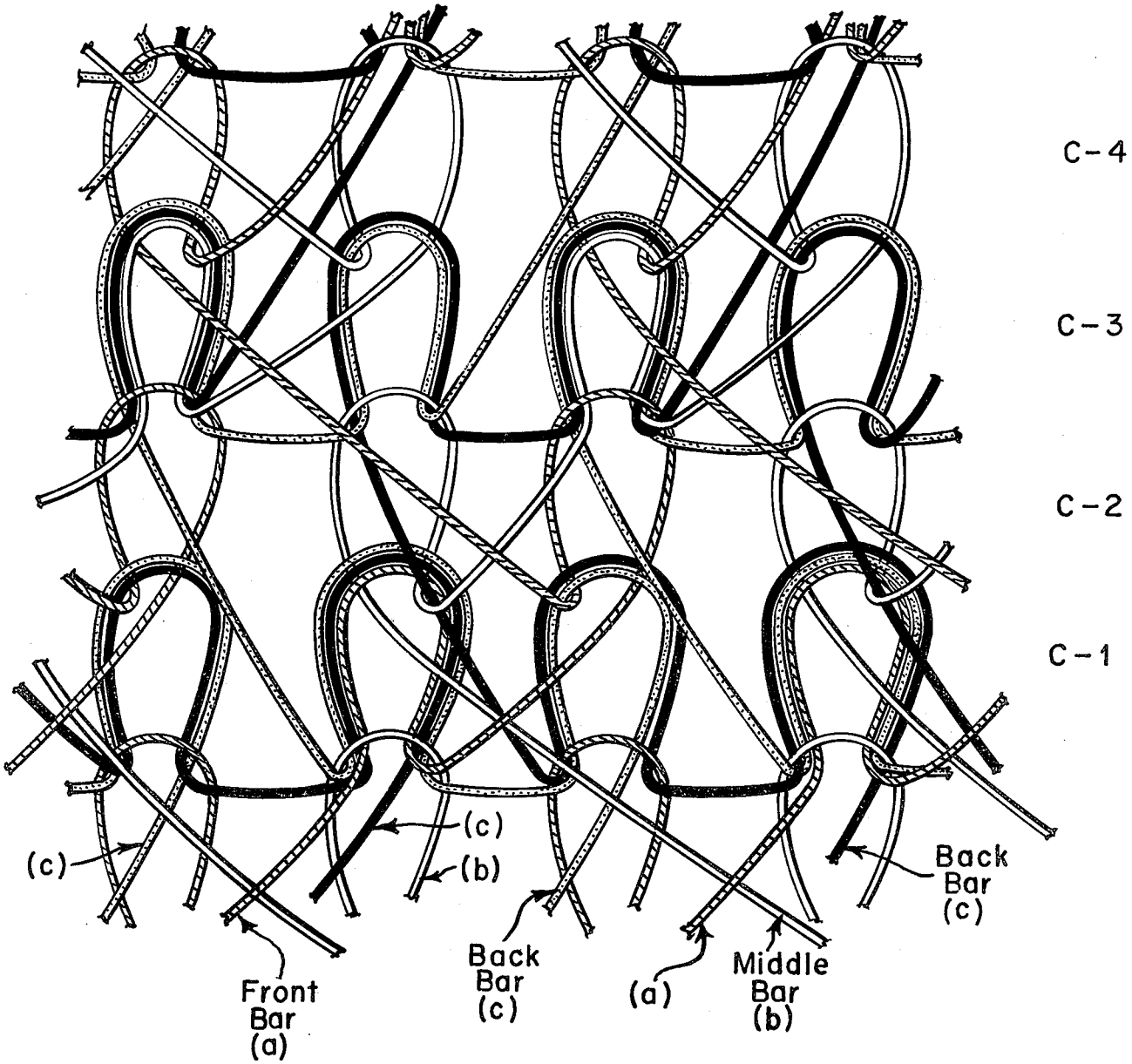
FIG. 2 illustrates the structure of the warp knit elastic fabric of the invention when it is formed with two warps of non-elastic thread which knit on the same alternate courses when the elastic thread is not knitting and alternately in opposite intervening elastic courses with the elastic yarn.

The subject warp knit elastic fabrics are advantageously produced on a Raschel warp knitting machine which is threaded conventionally with one solid warp of elastomeric thread such as Lycra spandex which is referred to here as elastic yarn or elastic thread. A multiplicity of elastic threads arranged parallel to each other on an appropriate spool and threaded individually in separate spaced guiding fingers on a continuous bar for the purpose of guiding the individual threads around spaced knitting needles simultaneously so that the multiplicity of elastic threads will be wrapped simultaneously around pairs of knitting needles so that each elastic thread will form pairs of knitting loops in combination with adjacent elastic threads from the same warp. In addition to the one solid warp of elastic thread the machine must be threaded with the equivalent of one solid warp of a non-elastic yarn such as nylon. The elastic properties of the fabric result from the unique interlacing of the elastic and non-elastic yarns in the knitted structure illustrated in FIGS. 1, 2 and 3.

The novel feature of the knitted construction is that the elastic threads are programmed to knit every other course in the fabric and to float (miss stitch) on the alternate courses. At those courses where the elastic thread does knit, it wraps around two needles to form double stitches. This double stitching results in a lateral meshing of neighboring elastic threads in the fabric since each knitting loop of elastic thread is formed from the strands of two neighboring elastic threads drawn through a loop of non-elastic thread.

The requirement for the non-elastic thread is that there be a non-elastic thread forming a knitting loop on every knitting needle when the elastic thread skips a course (floats). In addition, the non-elastic thread must be programmed so that it does not continuously form stitches on the same needle in consecutive courses. Each knitting needle forms stitches that form a continuous wale line running the length of the fabric. A thread that knits on only one needle forms stitches in only one wale line. To impart satisfactory stretch properties to the fabric, the non-elastic thread must not form consecutive stitches in wale line. It must be programmed to form stitches in adjacent or non-adjacent wale lines, switching from one wale line to its neighbor on consecutive or on alternate courses when the non-elastic thread knits.

The rate at which the elastic thread is fed to the knitting needles as the fabric is being formed determines the amount of tension produced in the elastic thread during knitting. The tension under which the elastic thread is knit determines the stretch and power characteristics of the fabric. The amount of tension of the elastic thread which is possible when elastic thread is knit is limited by the effect of the bending force the thread tension puts on the knitting needles during loop formation. In warp knitted elastic fabric of the invention, there is a greater latitude for knitting the elastic thread under tension because the bending forces applied to the knitting needles by the elastic thread during loop formation is neutralized because adjacent elastic threads apply bending forces to the knitting needles in opposite directions when all of the elastic threads form double knitting loops simultaneously around adjacent pairs of knitting needles.

The non-elastic thread is fed to the needles at a rate determined by the length of the stitches being formed. The weight, the opacity and the hand of the fabric are determined by the size of the stitches formed and the weight of the non-elastic thread. The size of the stitches is controllable in the normal range of knitting machine settings.

In addition, knitting and floating on alternate courses creates two levels of demand for elastic thread; one low as the elastic thread floats on an axis parallel to the length of the fabric and the other tension is high and on an axis parallel to the width of the fabric. These two sets of stretch characteristics make it possible to manipulate the fabric during the finishing process to develop long low-tension stretch in the fabric for comfort stretch in one direction in garments made thereof and high tension at right angles to the long stretch for support and human figure control in these garments.

The warp knitted elastic fabric of the invention is useful in garments wherein it is desirable to have a long easy comfort-type stretch in the direction corresponding to the length of the garment and power control-type stretch in the direction corresponding to the width of the garment and wherein lightweight opacity with a soft hand are also desirable features.

I claim:

1. A warp knitted elastic fabric having a soft hand, lightweight opacity, streak-free uniforming and low-modulus human figure-control type stretch in one direction and high-modulus form-fitting comfort stretch in the other direction at right angles to said first direction comprising a. a plurality of elastic threads and a plurality of non-elastic threads forming alternate elastic courses and intervening non-elastic courses, b. a plurality of elastic threads arranged in a solid warp of elastic threads and formed into a plurality of adjacent connected wales in alternate elastic courses only, when at least half of the non-elastic threads are floating, and c. wherein on the alternate elastic courses when the elastic threads are knitting each thread forms two stitches which are components of two adjacent wales in the same course.

2. A warp knitted elastic fabric having a soft hand, lightweight opacity, streak-free uniformity and low-modulus human figure-control type stretch in one direction and high-modulus form-fitting comfort stretch in the other direction at right angles to said first direction comprising a. a plurality of elastic threads formed into a plurality of alternate courses when the non-elastic threads are floating, and b. in alternate courses when the elastic thread forms stitches each elastic thread forms two stitches which are components of two adjacent wales in the same course, and c. a plurality of non-elastic threads formed into adjacent wales in intervening courses of single-thread stitches.

3. A warp knitted elastic fabric having a soft hand, lightweight opacity, streak-free uniformity and low-modulus human figure-control type stretch in one direction and high-modulus form-fitting comfort stretch in the other direction at right angles to said first direction comprising a. a plurality of elastic threads formed into a plurality of wales and a plurality of alternate courses when at least half of the non-elastic threads are floating, and b. in alternate courses when the elastic threads form stitches each elastic thread forms two stitches which are components of the adjacent wales in the course, and c. composed of a plurality of non-elastic threads arranged in the systems of warps forming all of the stitches in intervening courses and floating at least half of the threads in the alternate courses.

4. A warp knitted elastic fabric having a soft hand, lightweight opacity, streak-free uniformity and low-modulus human figure-control type stretch in one direction and high-modulus form-fitting comfort stretch in the other direction at right angles to said first direction comprising a. a plurality of elastic threads arranged in a solidly threaded warp and an equal number of non-elastic threads arranged in a solid warp and threaded in two half-guage guide bars forming alternate elastic and intervening non-elastic courses, b. wherein the single warp of elastic threads is formed into a plurality of wales in alternate elastic courses when the non-elastic threads are floating, and c. in the alternate courses when the elastic thread knits each thread forms two stitches which are components of two adjacent wales in the same course, d. wherein the two warps of non-elastic thread form single stitches in alternate and intervening wales in the intervening non-elastic courses and float while moving laterally the distance of two wales in opposition to each other between consecutive intervening courses while the elastic thread is knitting and they reverse their lateral movement between the following intervening courses.

5. A warp knitted elastic fabric as defined in claim 4, wherein the bar movement patterns of the stitch construction diagram are, respectively, a front bar 44-02-22-64, middle bar 22-64-44-02 and back bar 04-44-62-22, said numerical description being Raschel designations for a knitted fabric construction.

* * * * *